United States Patent [19]

Cusimano

[11] Patent Number: 4,980,930

[45] Date of Patent: Jan. 1, 1991

[54] GARMENT WAISTBAND CONSTRUCTION

[75] Inventor: Joseph T. Cusimano, Ambler, Pa.

[73] Assignee: Crown Textile Company, Blue Bell, Pa.

[21] Appl. No.: 38,958

[22] Filed: Apr. 16, 1987

[51] Int. Cl.[5] ..... A41F 9/00

[52] U.S. Cl. ..... 2/220; 2/236; 428/102

[58] Field of Search ..... 2/220, 236, 221, 237, 2/76, 255; 428/102, 253, 284; 66/190, 192

[56] References Cited

U.S. PATENT DOCUMENTS

| | | | |
|---|---|---|---|
| 1,366,852 | 1/1921 | Von Rentsch | 2/236 |
| 2,667,643 | 2/1954 | Elman | 2/236 |
| 2,986,742 | 6/1961 | Kuber et al. | 2/236 |
| 3,279,221 | 10/1966 | Gliksmann | 66/192 |
| 3,571,814 | 3/1971 | Miller | 2/236 |
| 3,869,728 | 3/1975 | Spencer | 2/221 |
| 4,518,640 | 5/1985 | Wilkens | 428/102 |
| 4,551,994 | 11/1985 | Vailati et al. | 66/190 X |
| 4,631,932 | 12/1986 | Sommers | 66/192 |

OTHER PUBLICATIONS

*Modern Textiles Magazine,* Nov. 1965, "New Fabrics Without Weaving" by K. W. Bahlo, pp. 51–54.

*Primary Examiner*—Joseph J. Hail, III

*Attorney, Agent, or Firm*—Robert C. Podwil

[57] ABSTRACT

A garment waistband construction is provided. The waistband construction employs a strip of composite fabric comprising a nonwoven fabric having a layer of monofilament yarns of about 150 to about 1,050 denier attached thereto. The monofilament yarns are oriented along the width of the composite fabric strip.

7 Claims, 2 Drawing Sheets

GARMENT WAISTBAND CONSTRUCTION

BACKGROUND OF THE INVENTION

The use of waistband constructions in garments is well known. Numerous waistband constructions have been described in U.S. patents. Among these patents are the following: 1,928,838; 2,912,699; 3,064,269; 3,178,727; 3,414,907; 3,422,461; 3,559,213; 3,571,814; 3,869,728; 3,987 496; and 4,583,249 (assigned to the assignee of the present application).

The requirements for suitable waistband constructions are well established: (1) stiffness in the direction of the waistband width to eliminate or minimize "roll-over"; and (2) at least some stretchability in the longitudinal direction to accommodate variations in the girth of the wearer. Achievement of both of these criteria often requires a rather complex assembly of waistband parts, typically employing a discrete stiffening strip to prevent roll-over.

Generally, a soft barrier fabric is used as a cushion to separate the relatively hard and abrasive stiffening strip from the body of the wearer.

SUMMARY OF THE INVENTION

The present invention is directed to a waistband construction in which the functions of the stiffening strip and the barrier fabric are performed by the same waistband part, a composite fabric comprising a layer of nonwoven fabric having a layer of monofilament yarns stitched thereto and extending along the width of the waistband.

DETAILED DESCRIPTION OF THE INVENTION

Figure 2:
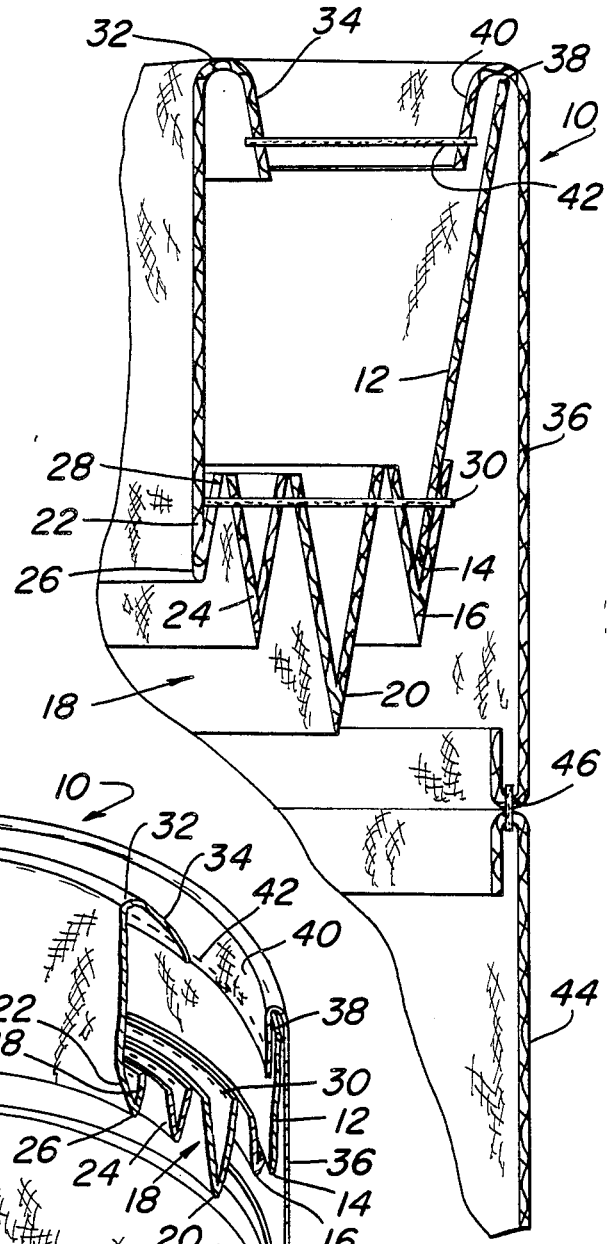
FIG. 2 is a sectional view of the waistband shown in FIG. 1.
Figure 1:
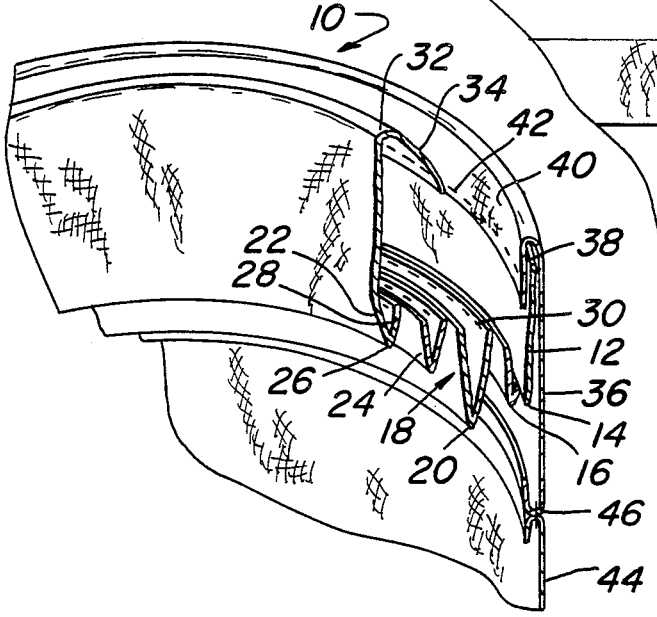
FIG. 1 is an isometric view of a waistband construction according to the invention.

A waistband construction 10 according to the present invention is shown in FIGS. 1 and 2. The waistband construction 10 comprises a composite fabric strip 12 which performs the functions of (a) preventing the waistband from rolling over, (b) providing a cushion, and (c) providing support to make the waistband functional.

The lower edge 14 of the composite fabric strip 12 is covered with a felling strip 16, such as buckram. Adjacent the felling strip 16 is a waistband curtain, indicated generally by 18. In the embodiment shown, the waistband curtain comprises a folded-over inner strip 20, separated from an outer strip 22 by an optional intermediate strip 24. The inner and outer strips 20, 22 can be made from the type of material typically used to make pockets. The intermediate strip 24 also can be made of pocket material, and can be used to provide a strip of decorative color between the inner and outer strips 20, 22. The lower edge 26 of strip 22 is folded inwardly to provide an inner fold 28. A stitch 30 secures the strips 12, 16, 20, 24 and inner fold 28 together. The outer strip 22 is folded over at its upper edge 32 to provide an inner fold 34.

The waistband construction 10 is sewn to a garment fabric as shown in FIGS. 1 and 2. A garment waistband strip 36 is folded over the upper edge 38 of composite strip 12 to provide an inner fold 40.

Stitching 42 is used to sew the inner fold 34 and inner fold 40 together. The remainder of the garment, indicated generally by 44, is sewn to the lower edge 46 of the garment strip 36.

Figure 3:
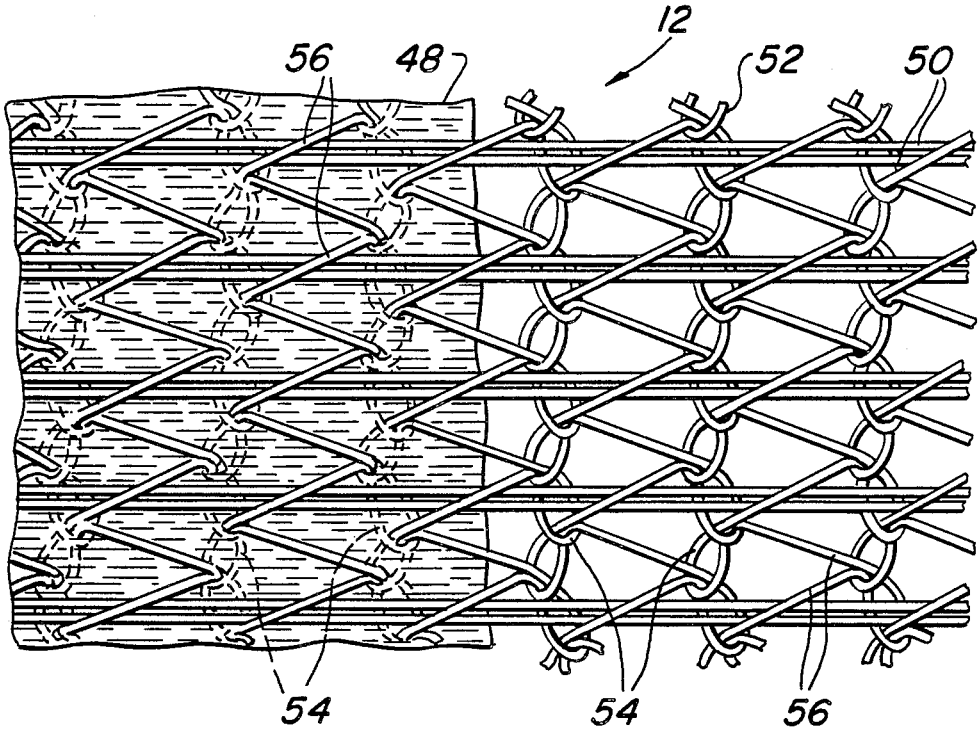
FIG. 3 is a plan view of a composite fabric for use in the waistband construction according to the invention.

Referring now to FIG. 3, the composite fabric strip 12 includes a relatively thin layer of nonwoven fabric 48 formed of closely compacted fibers and a layer of inlaid monofilament yarns 50. Advantageously, the monofilament yarns are from about 150 to about 1050 denier. Stitch yarn 52 is knit in a warp knit stitch pattern through the layer of nonwoven fabric 48 and incorporates the inlaid monofilament yarns 50 therein. The stitch yarn 52 forms a plurality of side-by-side walewise extending stitch loop chains 54 on one side of the composite strip 12 and forms diagonally extending laps 56 on the other side. The laps 56 extend in a zig zag path between adjacent wales of the stitch loop chains 54. Thus, the stitch yarn 52 is knit through and connects the layer of nonwoven fabric 48 with the layer of inlaid monofilament yarns 50. The strip 12 may be cut from large machine rolls of fabric by any convenient means, although ultrasonic slitting is presently preferred. Composite fabric in accordance with the foregoing description is cut to form composite strip 12 such that monofilament yarns 50 can be oriented in the waistband construction 10 in the direction of the waistband's width, i.e., in the direction in which the legs extend from the waistband construction. In this orientation, the monofilament yarns 50 provide stiffness which minimizes or prevents roll-over. Preferably, the composite strip 12 is oriented within the waistband Construction Such that nonwoven fabric 48 faces the waist of the wearer, thereby providing a cushion between the relatively stiff monofilament yarns 50 and the wearer.

The foregoing description is offered only by way of illustration, the scope of the present invention being defined by the claims which follow.

WHAT IS CLAIMED IS:

1. A garment waistband construction comprising a waistband strip adapted to be coupled to a garment, a waistband curtain disposed within the circumference of said waistband when the waistband is operatively disposed, and a composite fabric strip disposed within said waistband strip and coupled to said waistband curtain, said composite fabric strip providing a stiffening support for the waistband construction and preventing the waistband from rolling over, said composite strip comprising a layer of non-woven fabric, monofilament yarns affixed to said layer of non-woven fabric, and stitching yarns extending through said layer of non-woven fabric, and securing said monofilament yarns to said layer of non-woven fabric, said monofilament yarns being oriented in the direction of the width of said strip of composite fabric, whereby the stiffness of said monofilament yarns prevents rolling over of the waistband.

2. A garment waistband construction in accordance with claim 1, wherein said monofilament yarns are of about 150 to about 1050 denier.

3. A garment waistband construction in accordance with claim 1, wherein said waistband curtain comprises an inner strip and an outer strip, said outer strip and said waistband strip being coupled together adjacent the respective upper edges thereof, and said composite fabric strip being coupled to said inner strip adjacent to a lower edge of said composite strip.

4. A garment waistband construction in accordance with claim 3, wherein said monofilament yarns are of about 150 to about 1050 denier.

5. A garment waistband construction in accordance with claim 4, wherein said outer strip and said waistband strip and said composite fabric strip and said inner strip are coupled by stitches.

6. A garment waistband construction in accordance with claim 5, and an intermediate strip disposed between said outer strip and said lower edge of said composite strip.

7. A garment waistband construction in accordance with claim 6, wherein said monofilament yarns are affixed to one face of said layer of non-woven fabric and said composite fabric strip is so oriented with respect to said waistband strip that said monofilament yarns face said waistband strip and away from said waistband curtain.

* * * * *